US007861416B1

(12) United States Patent
Clark

(10) Patent No.: US 7,861,416 B1
(45) Date of Patent: Jan. 4, 2011

(54) FIREWOOD CUTTING GAGE CHAIN SAW ATTACHMENT

(76) Inventor: Ralph T. Clark, 3078 Meyers Hollow Rd., Marshfield, MO (US) 65706

( * ) Notice: Subject to any disclaimer, the term of this patent is extended or adjusted under 35 U.S.C. 154(b) by 321 days.

(21) Appl. No.: 12/006,685

(22) Filed: Jan. 4, 2008

Related U.S. Application Data

(60) Provisional application No. 60/879,495, filed on Jan. 9, 2007.

(51) Int. Cl.
*B27B 17/02* (2006.01)

(52) U.S. Cl. ..... 30/371; 30/383; 33/630

(58) Field of Classification Search ..... 30/371, 30/383; 33/263, 630, 700
See application file for complete search history.

(56) References Cited

U.S. PATENT DOCUMENTS

| | | | | | |
|---|---|---|---|---|---|
| 2,296,240 | A | * | 9/1942 | Biux | 30/385 |
| 3,514,214 | A | * | 5/1970 | Vogtle et al. | 416/3 |
| 3,531,870 | A | * | 10/1970 | Romancky | 33/630 |
| 4,185,382 | A | | 1/1980 | Rawlinson, Jr. | |
| 4,233,739 | A | | 11/1980 | Henrichs | |
| 4,299,034 | A | | 11/1981 | DeBetta | |
| 4,319,404 | A | | 3/1982 | Brock | |
| 4,341,018 | A | | 7/1982 | Nelson et al. | |
| 4,377,910 | A | | 3/1983 | Landry | |
| 4,388,762 | A | | 6/1983 | DeBell et al. | |
| 4,545,122 | A | | 10/1985 | Durfee, Jr. | |
| 4,561,186 | A | | 12/1985 | Keefe | |
| 4,603,715 | A | * | 8/1986 | Muehlhauser | 144/48.5 |
| 4,625,407 | A | | 12/1986 | Wallis | |
| 4,984,371 | A | | 1/1991 | Fredrickson | |
| 5,901,457 | A | * | 5/1999 | Harding | 33/630 |
| 6,295,738 | B1 | | 10/2001 | Risch | |
| 7,051,444 | B1 | | 5/2006 | Hofer | |

FOREIGN PATENT DOCUMENTS

| | | | |
|---|---|---|---|
| CH | 664 323 A5 | * | 2/1988 |
| DE | 10 2006 031 125 B3 | * | 10/2007 |

* cited by examiner

*Primary Examiner*—Hwei-Siu C Payer
(74) *Attorney, Agent, or Firm*—Richard L. Marsh

(57) ABSTRACT

A linear gauging device when attached to a chain saw bar will facilitate in the accurate measurement and swift successive cutting of a log into pre-determined uniform lengths of firewood. A chainsaw attachment consisting of an elongated resilient rod having one end fitted with a powerful magnet and an anti-slip locking stud, when extended through a single bore in the chainsaw bar, allows the effortless attachment to any chain saw bar. The locking stud fitted with a bore to receive a modified cotter pin thus performing a failsafe means of attachment. The said rod extended perpendicular to the cutting plane and lengthwise to the log. The opposing end of the rod is fitted with a large disc, when firmly locked against the end of the log, will position the chain saw cutting bar in the exact location of the measured length of cut. In contrast to the fixed measured length of the gauging rod, a variable length rod can be manufactured consisting of two rods, a hollowed outer rod and a telescoping inter rod. The outer rod having one bore perpendicular to the rod and extending through both sides of said hollowed rod. The inter rod having several perpendicular bores at two inch increments. This arrangement thus allows the gauging rod to be set at several different lengths by aligning desired inter rod bore with outer rod bore and inserting a modified cotter pin through said bores firmly locking the measured length adjustment in place.

3 Claims, 7 Drawing Sheets

FIREWOOD CUTTING GAGE CHAIN SAW ATTACHMENT

CROSS REFERENCE TO RELATED APPLICATIONS

This is a non-provisional application of provisional application 60/879,495 filed on Jan. 9, 2007.

BACKGROUND OF THE INVENTION

1. Field of the Invention

This invention relates to a chainsaw attachment which facilitates the measuring and cutting of a log into uniform lengths of firewood. More particularly, it relates to a chain saw attachment that substantially improves the accuracy and composure of measuring and cutting of uniform lengths of firewood in rapid succession without continual re-adjustment and does so with a safe, effortless, non-intrusive and versatile means of attachment to any chain saw bar.

There is a need for uniform cut firewood to conform to the size of a particular stove, big enough to fill the firebox acquiring maximum BTU output, yet small enough to fit through the opening. Uniform firewood is also easier to handle and transport than oddly cut pieces. A tight stack of uniform firewood not only is pleasing to the eye and space saving, it assures the customer of sufficient volume acquired.

2. Prior Art Statement

In the past the entire log was measured and hand marked before cutting. Items used for measuring include a tape measure, a yard stick, a piece of pre-cut wood, etc. Items used for marking include an axe, a hand saw, a pencil, spray paint, etc. This method is extremely time consuming and hazardous. It also requires hauling of these cumbersome items. U.S. Pat. No. 7,051,444, Benny A. Hofer, May 30, 2006 demonstrates a modern version of this method.

A more efficient method would be the use of a chainsaw attachment, incorporating the marking and cutting in one operation. It is generally known that this attachment would encompass a linear device of measured length extending perpendicular to the cutting plane of the chainsaw. When the opposing end of the linear device is aligned with the log end, the measured length of the cut becomes evident.

Most previously proposed attachments are mounted to the motor housing or handle of the chainsaw. U.S. Pat. No. 4,185,382, John P. Rawlinson, Jr., Jan. 29, 1980, U.S. Pat. No. 4,388,762 DeBell, et al., Jun. 21, 1983 and U.S. Pat. No. 4,545,122, David L. Durfee, Jr., Oct. 8, 1985 all attach to the chain cover bolts. On some new chainsaws these bolts have been eliminated making these attachments inoperable. Others have different thread or bolt sizes therefore requiring alterations to fit different chainsaws. U.S. Pat. No. 4,299,034, Joseph G. DeBetta, Nov. 10, 1981, U.S. Pat. No. 4,319,404, Helmut E. Brock, Mar. 16, 1982, U.S. Pat. No. 4,341,018, Nelson, et al., Jul. 27, 1982 and U.S. Pat. No. 4,625,407 F. Patrick Wallis, Dec. 2, 1986, all of which clamp to the chainsaw handle. These clamps are obstructive and hazardous. The chainsaw handle was fashioned to allow the placement of the operator's grip at various places along this handle to accommodate for the different cuts being made. For instance, when felling a tree the saw would be rotated in a horizontal position thus changing the operators grip from the top of the handle to the side.

Other previously proposed attachments are mounted to the chainsaw bar. U.S. Pat. No. 4,377,910, Ernest J. Landry, Mar. 29, 1983 employs a clamping device. Should this clamp be vibrated loose or slip into the operating chain the results could inflict severe injury. U.S. Pat. No. 4,561,186 Arthur N. Keefe, Dec. 31, 1985 depends on two small magnets and two pegs. Although the pegs do prevent slippage it would be difficult drilling the two accompanying holes exactly the right distance apart. The small magnets would have insufficient holding power in the rough environment of wood cutting. There is no backup preventing this device from falling or being knocked off, thus creating a potential hazard. The lineal measuring device, a tape measure, would be too fragile for this environment and would require frequent replacement.

It is further known a chainsaw measuring attachment to rely on line of sight to achieve the measured length of the cut. For instance, see the aforementioned U.S. Pat. No. 4,319,404 to Brock and U.S. Pat. No. 4,984,371, Robert N. Fredrickson, Jan. 15, 1991. This method is inaccurate. It relies on position and angle of the saw in relation to the operator and the log. A lot of time and effort is spent to acquire the right position. U.S. Pat. No. 6,295,738, Joel V. Risch, Oct. 2, 2001 employs a light, also depending on position and angle of the saw.

It is necessary to have the ability to measure from either end of the log otherwise the operator would need to climb over the log to facilitate measurement from the other end. This could put the operator in a hazardous position, for instance the downhill side of the log. This is a deficiency of most prior art.

The chainsaw attachment must have a failsafe connection to the saw, preventing an impact with the moving chain. On the other hand it must have the ability to be attached and completely removed, fast and easy, without the use of tools. This necessity becomes evident in the falling of a tree, the removal of small branches, the transportation and storage of the saw, etc. This is also a deficiency of most, if not all, prior art.

Another necessary attribute of the chainsaw attachment would be the ability to easily lock the opposing end of the lineal device to the end of the log, expediting fast and accurate measurement. Some prior art examples are completely deficient in this aspect, forcing the operator to estimate the alignment of the lineal device and the end of the log. Other prior art examples incorporate only a small hooking device, for instance a tape measure end, at the opposing end of the lineal device. The vibration of a running chainsaw makes the locking of these small appendages over the end of the log a difficult operation frequently requiring several attempts.

Although most homeowners would have the need of only one size gauge, the entrepreneur has the need of an adjustable gauge. This adjustment must be securely locked into position preventing the time consuming task of continued re-adjustment. U.S. Pat. No. 4,233,739, Leslie W. Henrichs, Nov. 18, 1980 and previously mentioned DeBell, et al., and Keefe rely on frictionally held devices for this adjustment, for instance, a tape measure lock or a telescoping tube. A frictionally held device would prove to be insufficient in this rough terrain. Only the slightest bump will knock these devices out of adjustment. Yet other prior art examples rely on screws, set screws, or nuts. The vibration of the chainsaw alone can work these adjustments loose presenting a potentially hazardous condition and at the least causing continual re-adjustment.

SUMMARY OF THE INVENTION

The aforementioned deficiencies possessed by the aforementioned prior art are resolved through the greatly improved yet simple and inexpensive attributes of the present invention.

The primary goal of the present invention is to provide a means of safely mounting to any and all chain saws, in a non-intrusive manner, which can easily, at any time, be swiftly and completely removed without the use of tools yet, would incorporate a failsafe method of attachment. This is accomplished through the use of a powerful magnet and one anti-slip locking stud extending through a bore in the tip of a chain saw bar. A modified cotter pin would then be inserted through this stud locking firmly into position.

A primary principal of the present invention is to provide a means of rapidly and firmly locking the linear device onto the end of the log, without repeated attempts, assuring an exact and swift measurement of each successive cut. This is achieved through the use of a large disc mounted on the free end of the linear measuring device.

A significant feature of the present invention is to provide a means of measurement from either end of the log. This is realized by the ability of the present invention to easily and swiftly mount to either side of the chain saw bar thus extending in either direction from the chain saw bar.

Another significant feature of the present invention is to provide a rapid and secure means of adjustment to accommodate the cutting of different lengths of firewood without the need of continual re-adjustment. This is accomplished by the use of two intersecting rods locked into position with a modified cotter pin.

A principal aim of this invention is to provide a lightweight yet rugged, damage resistance yet resilient device that can withstand the harsh environment of wood cutting and not affect the balance of the saw. This is attained by the solid one piece construction and lightweight materials used.

These and other significant objectives, advantages and novel features of the invention will be fully understood upon consideration of the following description of the preferred embodiments taken in conjunction with the accompanying drawings.

DESCRIPTION OF THE PREFERRED EMBODIMENTS

While the various features of this invention are hereinafter described as illustrated as a chain saw attachment used in the gauging, marking and cutting of uniform pieces of firewood, it is to be understood that the various features of this invention can be used singly or in various combinations thereof as can hereinafter be appreciated from the reading of the following description.

Figure 1:
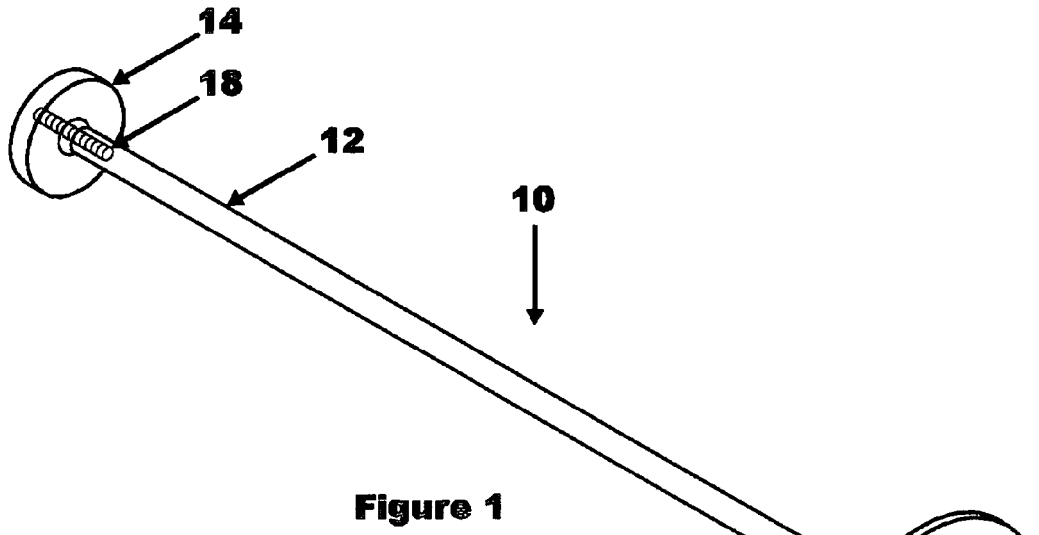
FIG. 1 is a perspective view of an embodiment of a chain saw attachment used in the gauging and cutting of firewood.
Figure 3:
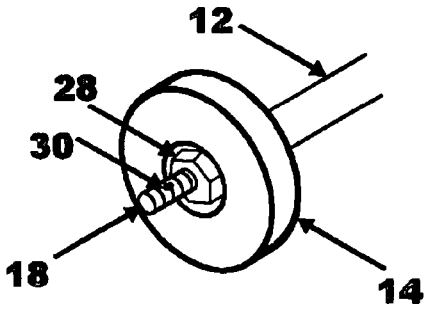
FIG. 3 is an enlarged view of the attaching end of the firewood gauge displaying the attachment of the magnet to the rod.
Figure 4A:
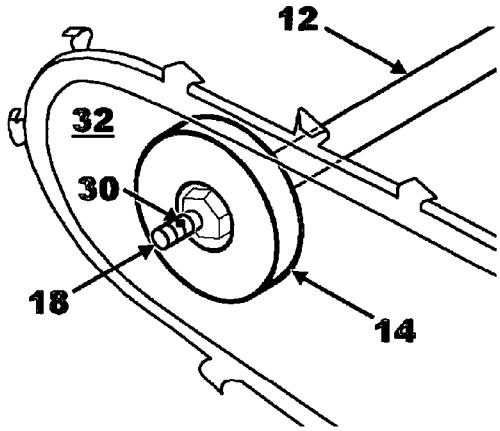
FIG. 4*a* is an enlarged view showing the means of attachment to the chain saw bar using the magnet alone.
Figure 4B:
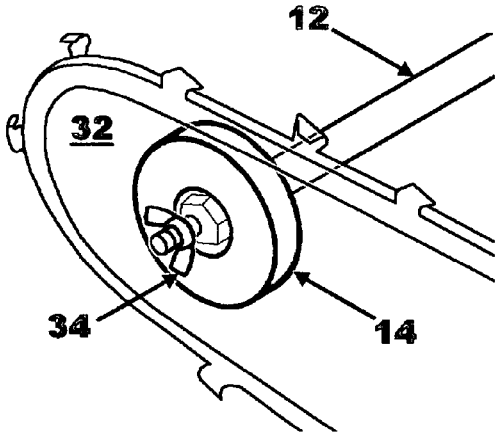
FIG. 4*b* is an enlarged view showing the means of attachment to the chain saw bar with a locking wing nut applied as a safety factor.
Figure 4C:
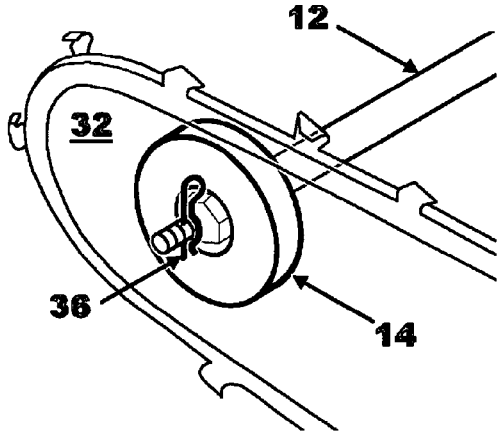
FIG. 4*c* is an enlarged view showing the means of attachment to the chain saw bar with the preferred failsafe locking modified cotter pin applied as a failsafe safety factor.

Referring now to FIG. 1, the improved firewood gauge 10 is of simple and inexpensive construction, being a single solid unit without the use of moving parts. There is no need to adjust, calibrate, align or alter in any way therefore eliminating the time consuming task of continual re-adjustment. The firewood gauge is a linear device 10 here now comprises a rod 12, a disc 16 and a locking stud 18 that can be fabricated as one unit in various lengths to accommodate the different lengths of firewood needed. Firewood gauge 10 can be fabricated out of fiberglass, metal, wood, carbon fiber, thermoplastics and combinations thereof, or other suitable materials, which would be durable, lightweight and resilient, able to withstand the rough environment of wood cutting. The encased permanent magnet 14 is attached to the threaded locking stud 18 with a lock washer and a nut 28 as illustrated in FIG. 3. The permanent magnet 14 possess 25 pounds of holding power sufficient enough when engaged to the chain saw bar 32, see FIG. 4*a*, to adequately hold the firewood gauge 10 in place. The locking stud 18, when inserted through a bore in the chain saw bar 32, see FIG. 4*a*, prevents the gauge 10 from slipping out of position. A modified cotter pin 36, see FIG. 4*c*, is inserted through a bore 30 in the locking stud 18 thus creating a failsafe attachment to any chain saw bar 32. With this arrangement the firewood gauge 10 can be easily and swiftly attached to or removed from any and all chain saws at any time without the use of tools. Simply push on, pull off. Also this non-intrusive arrangement requires no alteration to the motor housing, handle or any part of the chain saw body.

Figure 2:
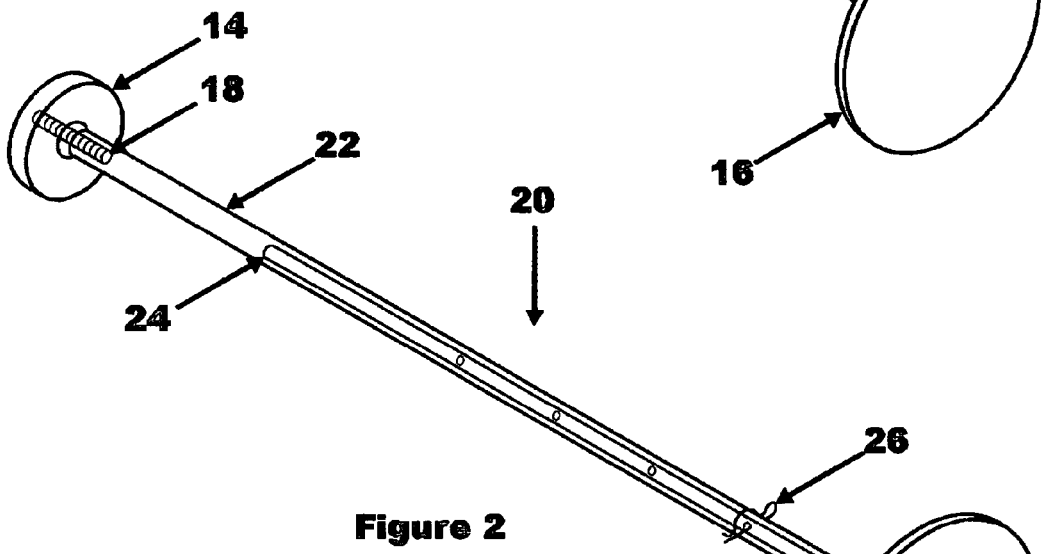
FIG. 2 is a perspective view of an alternate embodiment exhibiting an adjustable telescoping end.

Referring now to FIG. 2, the adjustable firewood gauge 20 can be manufactured as a two piece unit, the disc 16 and telescoping inner rod 24 as one unit and the hollowed outer rod 22 and locking stud 18 as another. The inner rod 24 being 14 inches long is fabricated with 4 bores 2 inches apart starting 4 inches from disc 16. The hollowed outer rod 22 is fabricated 18 inches long with one bore 4 inches from the terminal end of the hollowed outer rod 22 and extending through both sides of the hollowed outer rod 22. The inner rod 24 can thus slide within the hollowed outer rod 22, locking firmly into position with a modified cotter pin 26. With this arrangement it is near impossible to knock out of adjustment thus preventing the time consuming task of re-adjustment. This configuration permits the measuring and cutting of 18, 20, 22 and 24 inch pieces of firewood.

For those needing firewood longer than 24 inches, a gauge 10, 20 can be fabricated in the same manner as above. The hollowed outer rod 22 is fabricated 26 inches long and is hollowed to within 4 inches of the magnet 14. The inner rod 24 is fabricated 22 inches long with 6 bores at 2 inch increments starting 6 inches from disc 16. This configuration permits the measuring and cutting of 26, 28, 30, 32, 34 and 36 inch pieces of firewood.

Figure 5A:
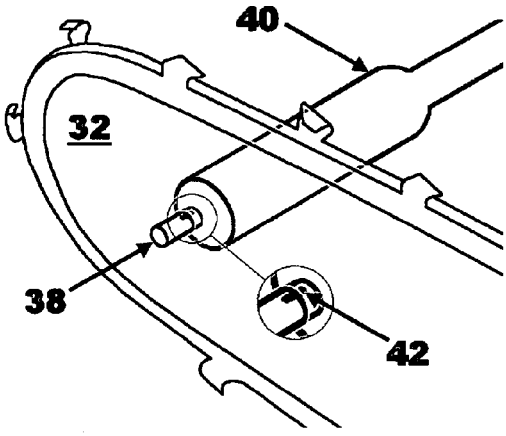
FIGS. 5*a* and 5*b* are enlarged views showing a means of attachment to the chain saw bar utilizing a slotted locking stud with various sized modified cotter pins.
Figure 5B:
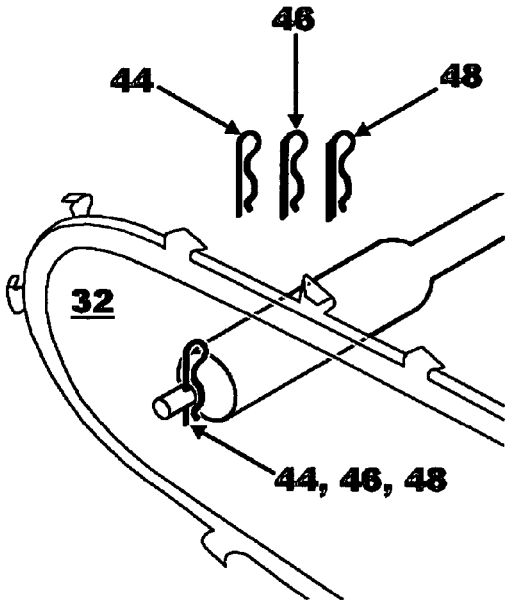

Referring now to FIG. 5, in order to reduce the manufacturing cost, the permanent magnet 14 can be eliminated. A flared stabilizing rod 40 would replace rod 12 and a slotted 42 non-threaded locking stud 38 would replace the threaded locking stud 18 as illustrated in FIG. 5*a*. The slotted 42 locking stud 38 when used in conjunction with the modified cotter pins 36 of various widths 44, 46 and 48, see FIG. 5*b*, would compensate for the various widths of assorted chainsaw bars therefore rendering a snug attachment to any chain saw bar 32.

Figure 6A:
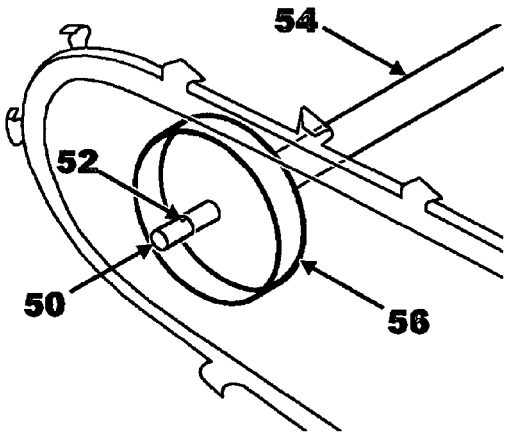
FIGS. 6*a* and 6*b* are enlarged views showing a means of attachment to the chain saw bar utilizing a flexible stabilizing cup and modified cotter pin.
Figure 6B:
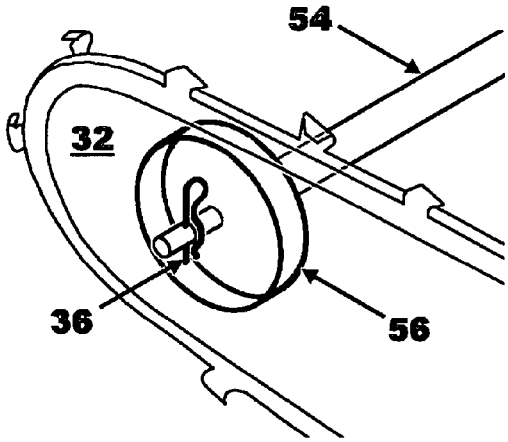

Another way of compensating for the various widths of assorted chain saw bars is illustrated in FIGS. 6*a* and 6*b*. Rod 54 would incorporate a flexible stabilizing cup 56. The locking stud 50 would have one bore 52 accepting the modified cotter pin 36.

Figure 7A:
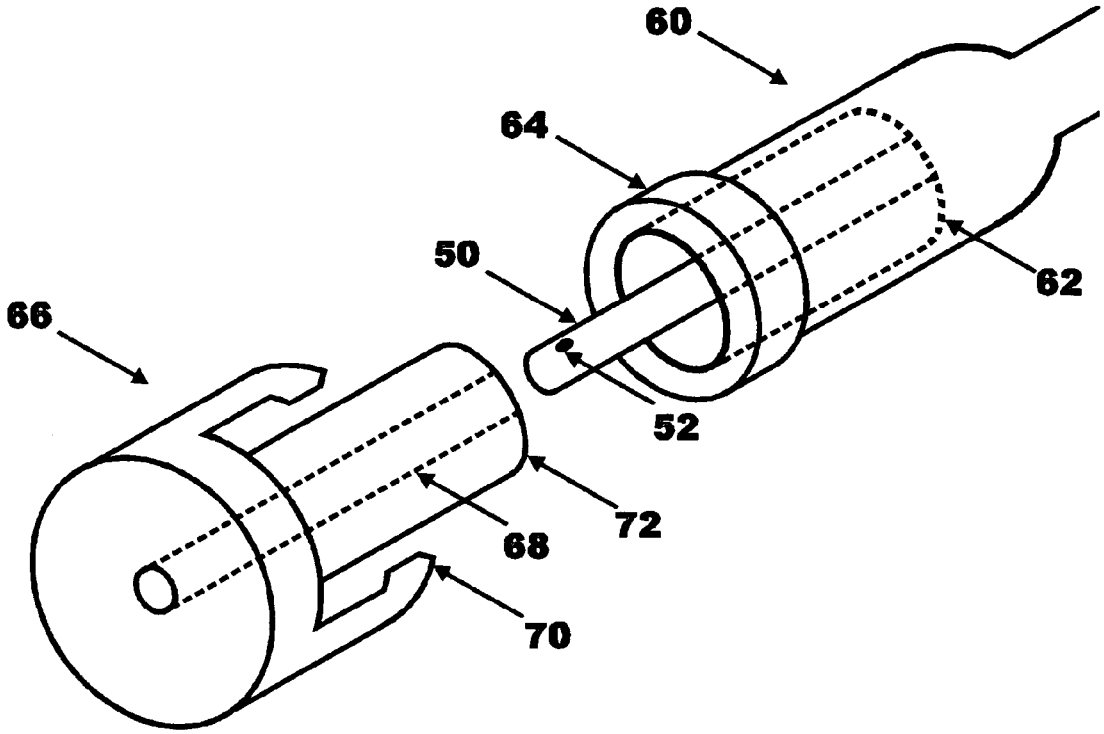
FIG. 7*a* is an enlarged perspective view of the spring loaded attaching end of the linear measuring device.
Figure 7B:
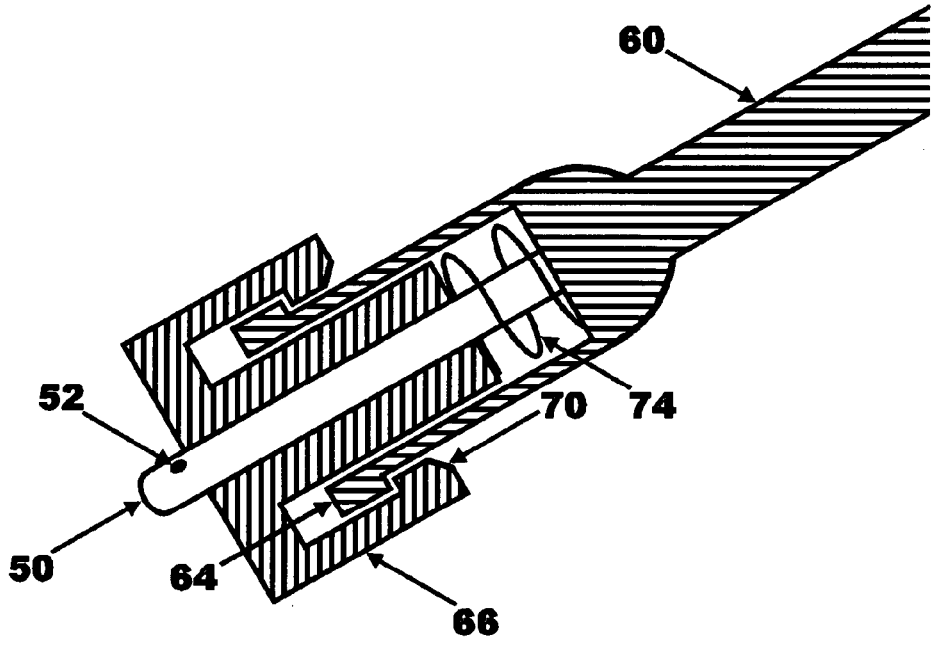
FIG. 7*b* is an enlarged cutaway view of the spring loaded attaching end of the linear measuring device.

Still another way of compensating for the various widths of assorted chain saw bars is illustrated in FIGS. 7*a* and 7*b*. The flared rod 60 composed of a hollowed end 62, a raised locking ring 64, and a locking stud 50 with one bore 52. The stabilizing platform 66 is composed of a single bore 68, at least two locking tangs 70 and an inner rod 72. In order to assemble, a stiff spring 74 is inserted into the hollowed end 62 of the rod 60. The stabilizing platform 66 is pushed onto the rod 60 with the locking stud 50 sliding through the single bore 68 of the stabilizing platform 66 and the inner rod 72 of the stabilizing platform 66 sliding into the hollowed end 62 of the rod 60. The stabilizing platform 66 locks onto the rod 60 by snapping the tangs 70 over the locking ring 64 creating a single spring loaded unit. This unit is attached to the chain saw bar 32 in much the failsafe manner as the other illustrations in FIGS. 4*c*, 5*b* and 6*b*.

Figure 8:
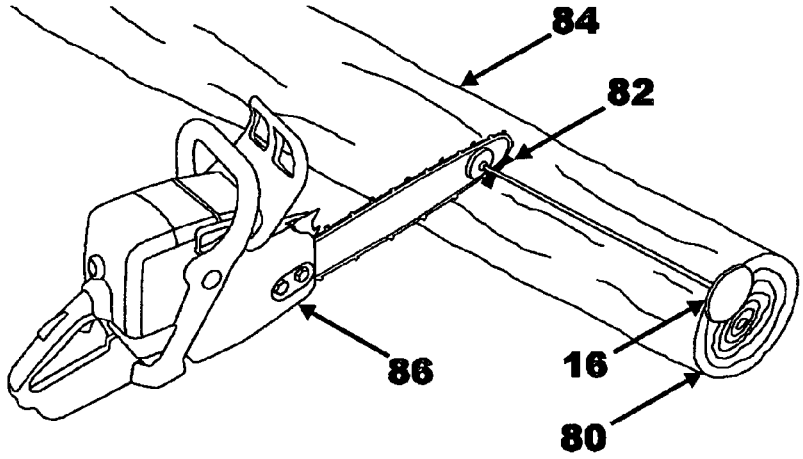
FIGS. 8, 9 and 10 are perspective views of the attached firewood gauge demonstrating the method of cutting the log.
Figure 9:
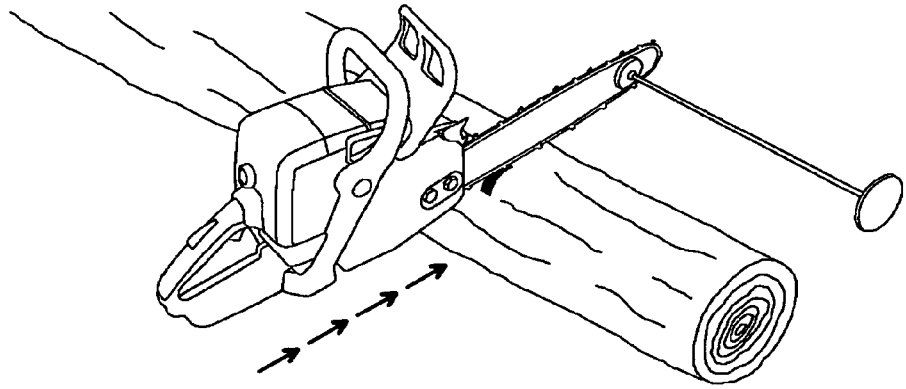
Figure 10:
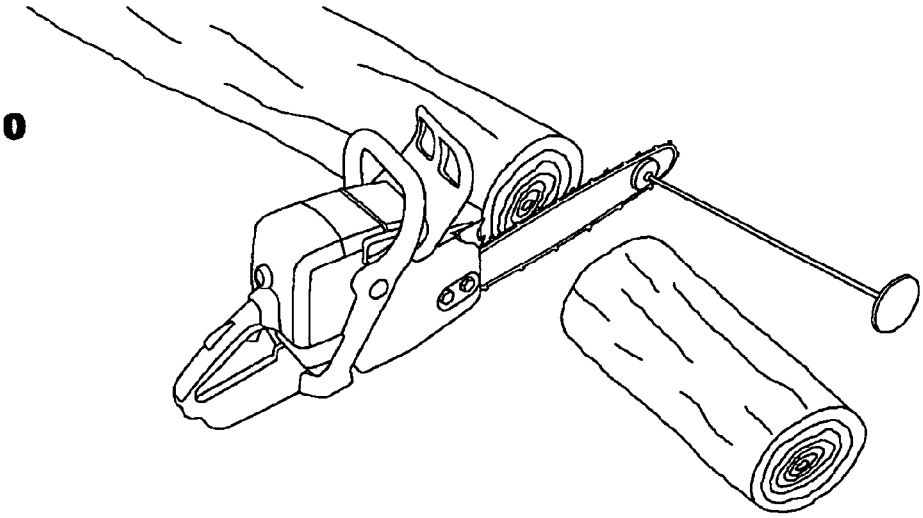

A time saving feature of this invention is the ability to measure, mark and cut in one simple motion. This maneuver is illustrated in FIGS. 8, 9 and 10. First place the disc 16 firmly against the logs end 80, see FIG. 8. This can be done swiftly without repeated attempts due to the enlarged disc 16. Cut a mark 82 into the log 84 with the chain saw 86. Move the chain saw 86 forward, following the direction of the arrows, into the cutting position, see FIG. 9. Make the cut as at cut mark 82, see FIG. 10. This method can be repeated in rapid secession down the full length of the log 84.

Thus, a method of cutting uniform length pieces of firewood from an elongated log 84 comprises the steps of mounting a firewood cutting gauge 10, 20 to a chain saw bar 32 proximate the free end thereof, engaging an inboard surface of an enlarged disc end 16 of firewood cutting gauge 10, 20 against an end 80 of an elongated log 84 to be cut, thus establishing a specified location 82 for the uniform length, engaging a chain of chain saw 86 against log 84, moving chainsaw 86 laterally over log 84 to disengage disc 16 from end 80 of log 84, operating chain saw 86 at specified location 82 to sever the uniform length of firewood from log 84, firewood cutting gauge 10 comprising at least a first elongated rod 12, 24, a disc 16, a magnet 14 and at least one fastener 34, 36, 44, 46, 48 wherein disc 16 is preferably permanently affixed to, but may alternately be removably mounted to one end of elongated rod 12, 24 and magnet 14 is removably affixed to an opposed end of elongated rod 12, 24, cutting gauge 10 removably affixed to one side of chain saw bar 32 with magnet 14, elongated rod 12, 24 additionally removably affixed to an opposed side of chain saw bar 32 with fastener 34, 36, 44, 46, 48 wherein the opposed end of elongated rod 12, 24 passes through a hole generally disposed through the free end of chain saw bar 32. It should be noted here, that most chain saw bars 32 have a hole about five/sixteenths inch in diameter through bar 32 proximate the free, or nose, end of bar 32. Though other fasteners may be contemplated, fastener 34, 36, 44, 46, 48 is preferably selected from the group comprising a wing nut, cotter pin, toggle pin, drift pin, trailer pin, implement pin or spring keeper and combinations thereof.

Figure 11:
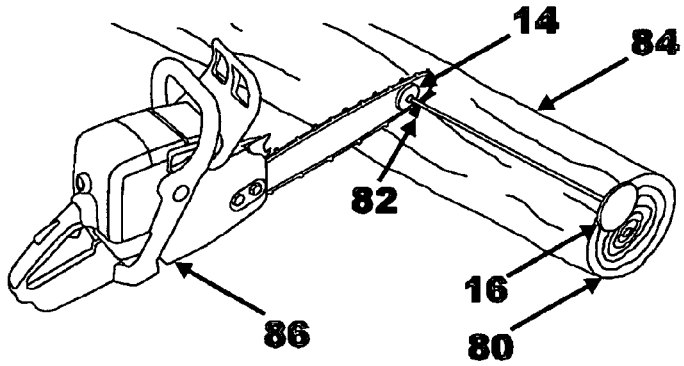
FIGS. 11, 12 and 13 are perspective views of the attached firewood gauge demonstrating the method of marking the log in preparation for the cuts.
Figure 12:
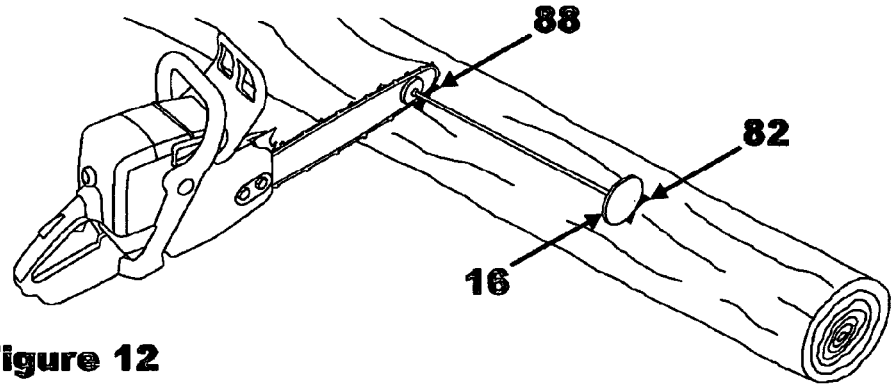
Figure 13:
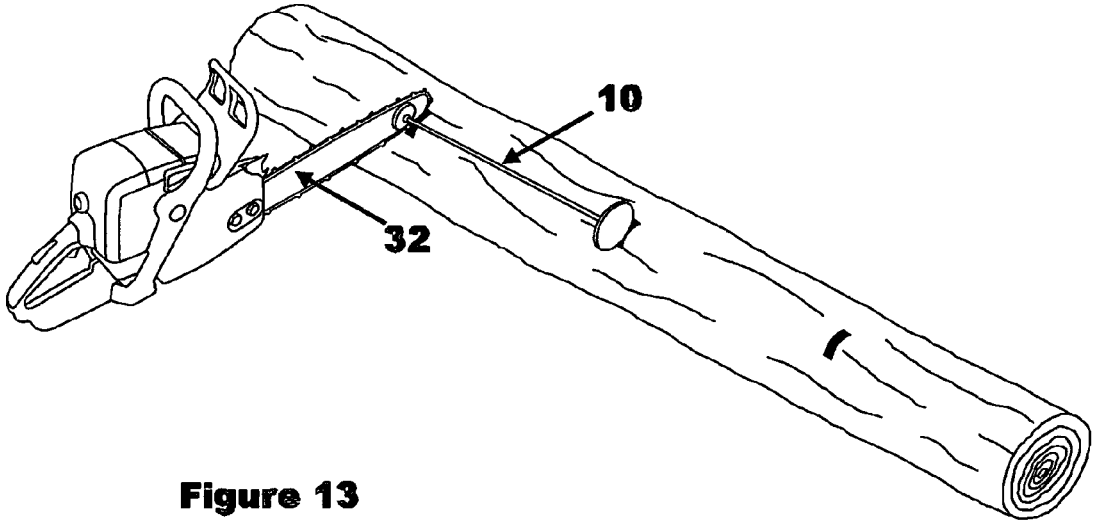

In certain circumstances there may be a need to pre-mark the entire log 84 before making the cuts. For instance, the log 84 is too wide to allow the firewood gauge 10, 20 to clear the log 84 while making the cut. This is also a simple operation as illustrated in FIGS. 11, 12 and 13. Again place the disk 16 firmly against the log's end 80, see FIG. 11. Cut a mark 82 into the log 84 with saw 86. The magnet casing 14 will stop the cut at the proper marking depth. Now move the saw 86 so to place the disc 16 into the previous cut mark 82 and cut a new mark 88. Continue repeating this method the entire length of the log 84, see FIG. 13. Remove the firewood gauge 10 from the chain saw bar 32 and make the cuts at each mark 82.

Figure 14:
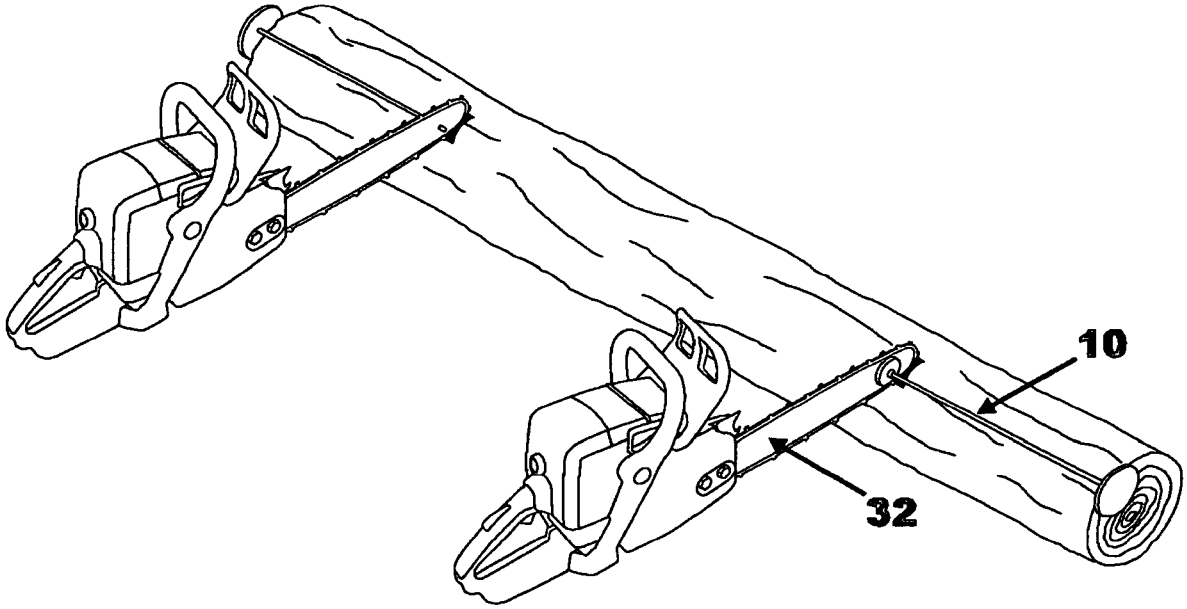
FIG. 14 is a perspective view of the attached firewood gauge demonstrating the ability of cutting from either end of the log.

Referring now to FIG. 14, another important attribute of this invention is the ability to cut from either end of the log 84. The firewood gauge 10 can easily and swiftly attach to either side of the chain saw bar 32 allowing for this maneuver. Simply pull off, push on.

While the present invention has been described with reference to the above described preferred embodiments and alternate embodiments, it should be noted that various other embodiments and modifications may be made without departing from the sprit of the invention. Therefore, the embodiments described herein and the drawings appended hereto are merely illustrative of the features of this invention and should not be construed to be the only variants thereof nor limited thereto.

I claim:

1. A firewood cutting gauge comprises an elongated rod, a disc and a removably secured failsafe means for attachment to a remote end of a chain saw cutting bar, said disc affixed to one end of said elongated rod and said means for attachment affixed to an opposite attaching end of said elongated rod, said means for attachment comprising an encased powerful permanent magnet, a locking stud, a lock washer, a nut and a fastener, said locking stud secured in a threaded bore in said attaching end of said elongated rod, said magnet of said means for attachment affixed to said attaching end of said elongated rod with said lock washer bearing against said magnet and with said nut threaded upon said locking stud, said locking stud extending through a hole disposed through said remote end of said cutting bar and wherein said means for attachment is secured in a failsafe manner to either side of said chain saw cutting bar with said fastener extending through a bore disposed in said locking stud and transverse to a longitudinal axis of said locking stud.

2. A firewood cutting gauge as in claim 1 wherein said fastener extending through said locking stud is a modified cotter pin.

3. A firewood cutting gauge as in claim 1 wherein said locking stud is threaded and permanently molded into said attaching end of said elongated rod, wherein said encased permanent magnet is attached to said attaching end of said elongated rod by means of said lock washer and said nut thus accomplishing assembly of said means for attachment to said chain saw bar.

* * * * *